US008820483B2

(12) United States Patent
Ericson et al.

(10) Patent No.: US 8,820,483 B2
(45) Date of Patent: Sep. 2, 2014

(54) ELEVATOR MACHINE SUPPORT

(75) Inventors: Richard J. Ericson, Southington, CT (US); Harold Terry, Avon, CT (US); Leandre Adifon, Farmington, CT (US); Stephen R. Nichols, Plantsville, CT (US); Robin Mihekun Miller, Glastonbury, CT (US); Daryl J. Marvin, Farmington, CT (US); John Ferrisi, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 463 days.

(21) Appl. No.: 13/132,096

(22) PCT Filed: Dec. 5, 2008

(86) PCT No.: PCT/US2008/085637
§ 371 (c)(1),
(2), (4) Date: Jun. 1, 2011

(87) PCT Pub. No.: WO2010/065038
PCT Pub. Date: Jun. 10, 2010

(65) Prior Publication Data
US 2011/0226557 A1 Sep. 22, 2011

(51) Int. Cl.
*B66B 11/00* (2006.01)
*B66B 19/00* (2006.01)

(52) U.S. Cl.
CPC ..... *B66B 19/005* (2013.01); *B66B 11/0045* (2013.01)
USPC ..... 187/266

(58) Field of Classification Search
CPC ..... B66B 11/08; B66B 11/04; B66B 7/00
USPC ..... 187/254, 266
See application file for complete search history.

(56) References Cited

U.S. PATENT DOCUMENTS 6,006,865 A * 12/1999 Ammon ..... 187/266
6,193,017 B1 2/2001 Koster (Continued)

FOREIGN PATENT DOCUMENTS

DE 1740974 U 3/1957
DE 102005002607 A1 8/2006

(Continued)

OTHER PUBLICATIONS

Search Report and Written Opinion mailed on Aug. 28, 2009 for PCT/US2008/085637.

(Continued)

*Primary Examiner* — Michael Mansen
*Assistant Examiner* — Diem Tran
(74) *Attorney, Agent, or Firm* — Carlson, Gaskey & Olds

(57) ABSTRACT

An exemplary elevator system comprises a machine support (30) including a first portion (32) situated in a generally horizontal position at least partially within a hoistway (24). A second portion (34) is oriented generally perpendicular to the first portion. The second portion has one end supported by a support surface (52) adjacent the hoistway such that a portion of a load of the machine support is transferred to the support surface. One end of the first portion (32) is supported by the second portion (34) and another end of the first portion is supported by a structural member at least partially in the hoistway such that a remainder of the load of the machine support is transferred to the structural member.

20 Claims, 6 Drawing Sheets

(56) References Cited

U.S. PATENT DOCUMENTS

| | | | |
|---|---|---|---|
| 6,446,762 | B1 | 9/2002 | St. Pierre et al. |
| 6,488,124 | B1 | 12/2002 | Yasuda et al. |
| 7,364,019 | B2 | 4/2008 | Faletto |
| 7,383,924 | B2 | 6/2008 | Izumi et al. |
| 2005/0087397 | A1 | 4/2005 | Faletto |

FOREIGN PATENT DOCUMENTS

| | | | | |
|---|---|---|---|---|
| EP | 0621224 | A2 | 10/1994 | |
| EP | 1329411 | A1 | 7/2003 | |
| EP | 1081085 | B1 | 10/2003 | |
| EP | 1431231 | A | 6/2004 | |
| EP | 1520831 | | 4/2005 | |
| EP | 1568644 | A1 | 8/2005 | |
| EP | 1266859 | B1 | 10/2006 | |
| WO | WO99/43596 | | 9/1999 | |
| WO | WO 01/74704 | | 10/2001 | |
| WO | WO03/048020 | A1 | 6/2003 | |
| WO | WO 2005005303 | A1 * | 1/2005 | ..... B66B 11/04 |

OTHER PUBLICATIONS

International Preliminary Report on Patentability for International application No. PCT/US2008/085637 mailed Jun. 16, 2011.

* cited by examiner

ELEVATOR MACHINE SUPPORT

BACKGROUND

Elevators carry passengers, cargo or both between different levels in a building, for example. There are different mechanisms for moving an elevator car within a hoistway. Traction-based elevator systems utilize a roping arrangement for suspending the elevator car and moving the car as desired. Most traction based systems include a counterweight.

Traditionally, traction based elevator systems included a machine room in which the elevator machine, drive and control components were located. For example, a separate structural room would be placed on top of a hoistway on a roof of a building. The machine room provides access to the motor, brake, drive and controller components for service and maintenance operations, for example.

A modern trend in elevator systems has been to eliminate the machine room and provide a machine roomless elevator system. Eliminating the machine room provides the advantage reducing construction cost otherwise associated with providing a separate machine room, for example. While there are advantages associated with eliminating the requirement for a machine room, certain challenges are introduced.

For example, strategic placement of the elevator components is required to provide an adequate machine support that also supports the loads of the elevator system. At the same time, the desire is to keep cost down and to minimize the complexity of the installation process. Another issue that is presented by machine roomless elevator systems is that a technician or mechanic may need to enter the hoistway for maintenance or service procedures. It is desirable to limit the amount of time that an individual needs to be within the hoistway for such procedures.

Various proposals have been made for supporting elevator system components within a hoistway for a machine roomless configuration. Examples are shown in U.S. Pat. No. 6,446,762, EP 1,266,859, WO 99/43596 and EP 1,329,411. Those skilled in the art are always striving to make improvements in areas such as simplifying installation procedures, reducing costs associated with elevator system components and installation and decreasing the burden on service personnel for performing maintenance and service procedures.

SUMMARY

An exemplary elevator system comprises a machine support including a first portion situated in a generally horizontal position at least partially within a hoistway. A second portion is oriented generally perpendicular to the first portion. The second portion has one end supported by a horizontally oriented support surface adjacent the hoistway such that a portion of a load of the machine support is transferred to the support surface. One end of the first portion is supported by the second portion and another end of the first portion is supported by a structural member at least partially in the hoistway such that a remainder of the load of the machine support is transferred to the structural member.

An exemplary machine support for use in an elevator system comprises a first portion configured to be disposed at least partially within a hoistway. A second portion is pivotally connected with the first portion to allow for selective relative movement between the first and second portions between a first configuration in which the first and second portions are generally parallel to each other and a second configuration in which the first and second portions are generally perpendicular to each other.

The various features and advantages of the disclosed examples will become apparent to those skilled in the art from the following detailed description. The drawings that accompany the detailed description can be briefly described as follows.

DETAILED DESCRIPTION

Figure 1:
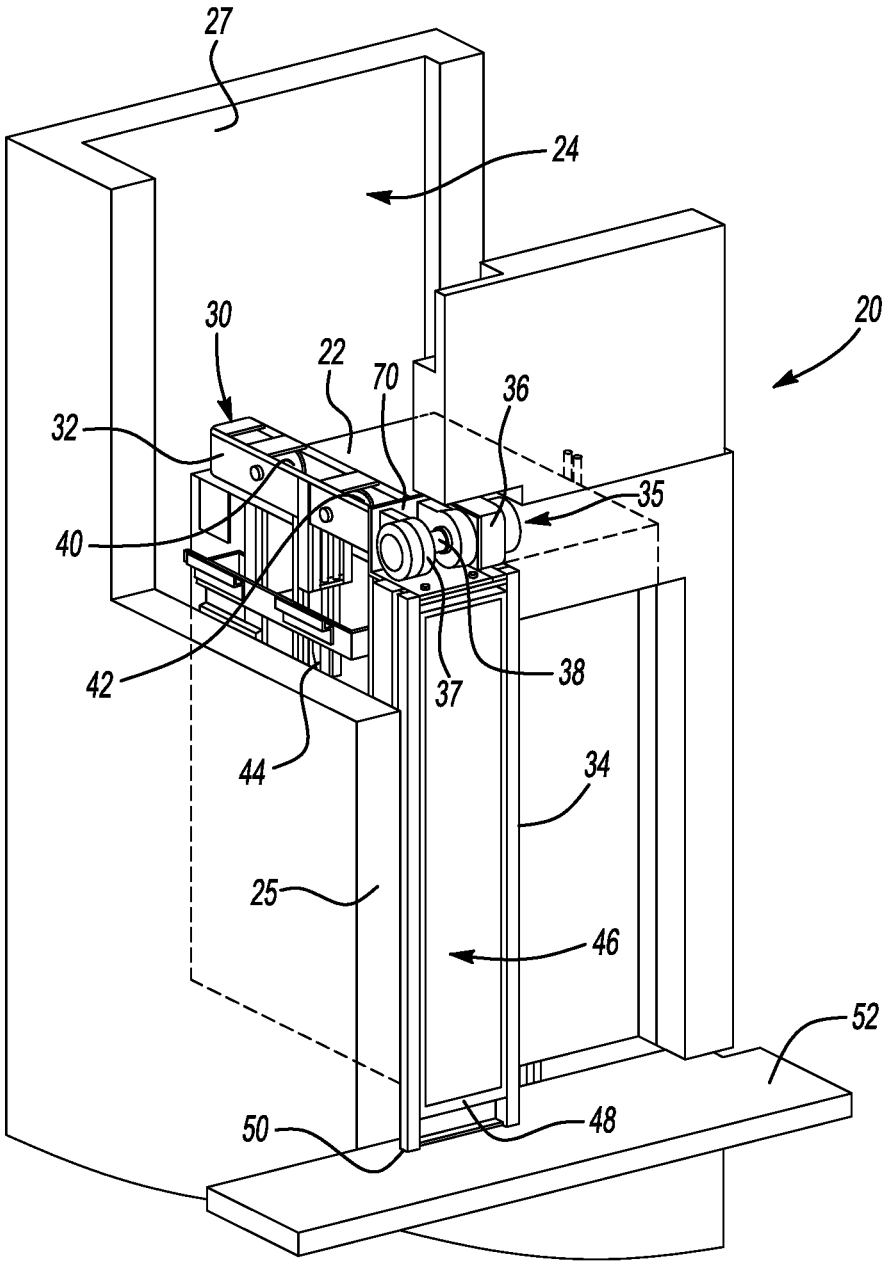
FIG. 1 diagrammatically illustrates selected portions of an elevator system including a machine support designed according to an embodiment of this invention.
Figure 2:
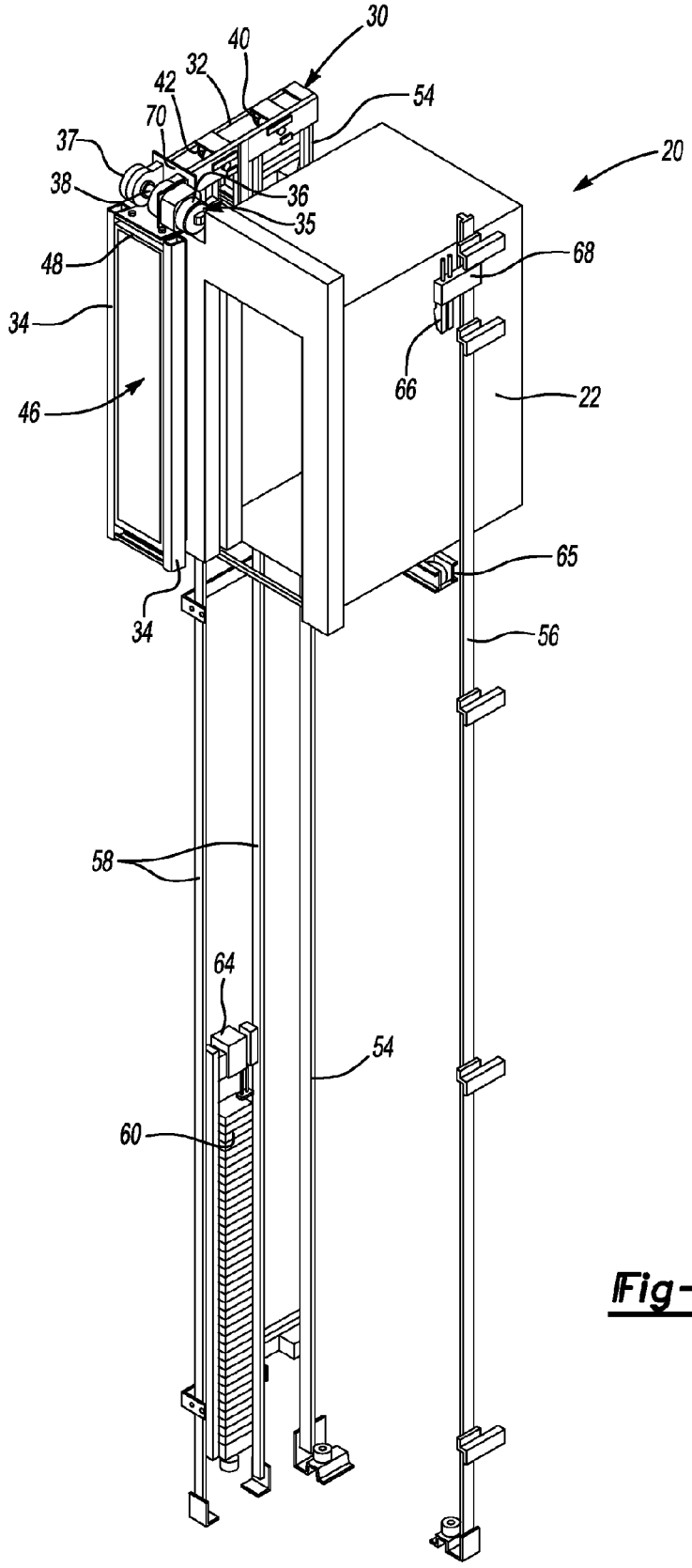
FIG. 2 diagrammatically illustrates selected features of the embodiment of FIG. 1 from another perspective.
Figure 3:
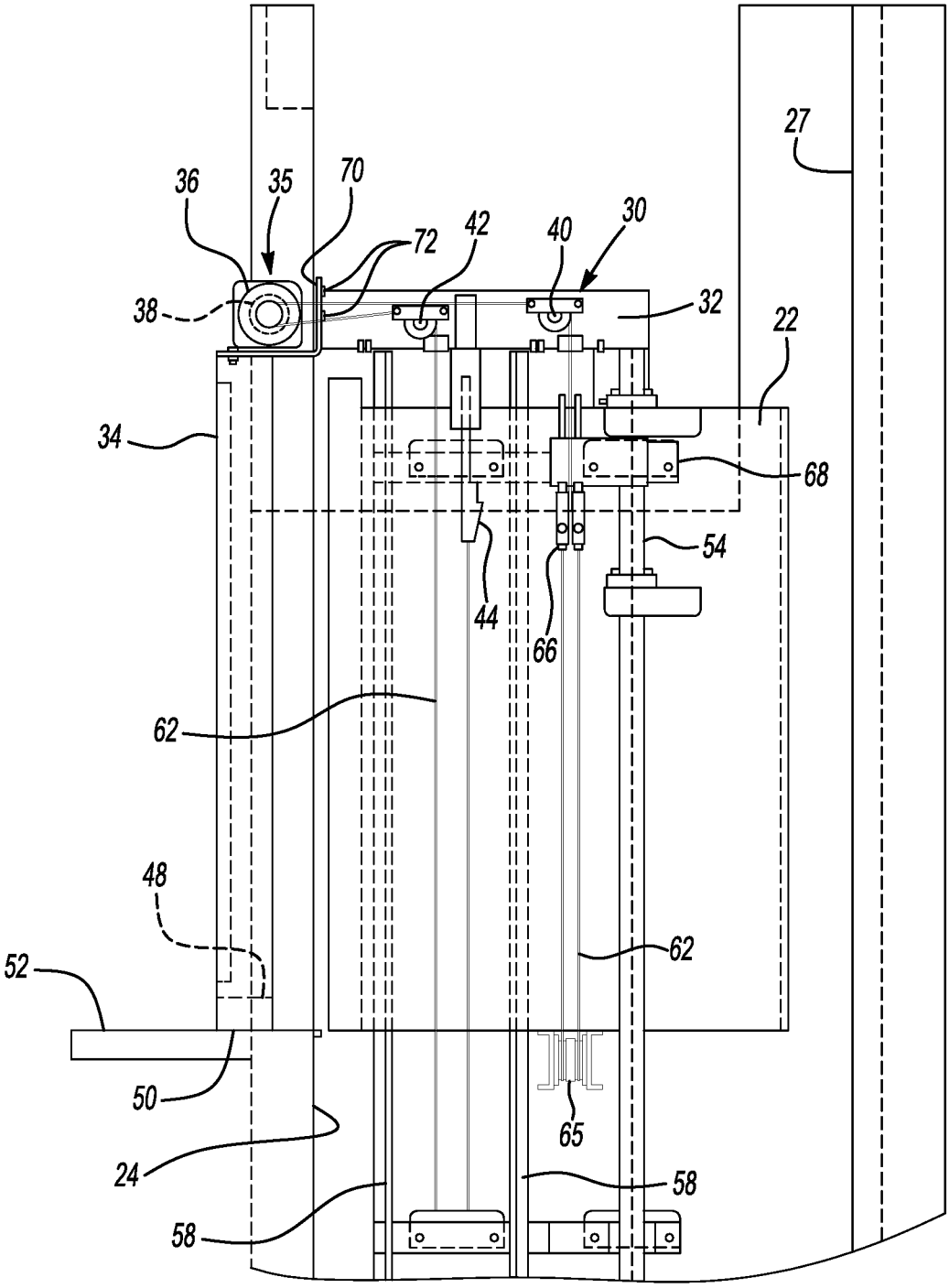
FIG. 3 is a side view illustrating selected features of the example of FIG. 1.

FIGS. 1-3 illustrate selected portions of an example elevator system 20. An elevator car 22 moves within a hoistway 24 to provide desired elevator service. An elevator machine support 30 includes a first portion 32 and a second portion 34. An elevator machine 35 (e.g., a motor 36 and brake 37) and an associated traction sheave 38 are mounted on the machine support 30. In the illustrated example, the traction sheave 38 is a part of a shaft of the motor 36. In other examples, the sheave 38 is a separate component associated with the motor shaft.

In the illustrated example, the first portion 32 of the machine support 30 is at least partially within the hoistway 24 and is aligned horizontally (e.g., generally parallel with the floor of the elevator car 22). The second portion 34 is generally perpendicular to the first portion 32. The second portion 34 in this example is located at least partially outside of the hoistway 24. The second portion 34 extends below the first portion 32 to transfer a portion of the load of the machine support 30 to the building structure outside of the hoistway 24.

The first portion 32 supports deflection sheaves 40 and 42 and a plurality of roping terminations 44. The second portion 34 supports a housing 48 useful for housing elevator system components (e.g., electronic components 46 such as the drive for controlling operation of the machine 35 and the controller general operation of the car 22). In this example, the housing 48 is positioned within an envelope of the second portion 34. In one example, the housing 48 comprises a structurally rigid material that cooperates with the structure of the second portion 34 (e.g., metal beams) such that the housing 48 at least partially bears some of the load supported by the second portion 34.

In this example, the second portion 34 has one end 50 resting upon a horizontally oriented support surface 52. In one example, the surface 52 is coincident with a floor at a landing as shown in FIG. 1. In this example, the support surface 52 is at the uppermost landing of the hoistway 24 serviced by the elevator car 22.

The support surface 52 may be spaced from a landing floor. One example includes a notched portion of a wall (e.g., a portion of the wall is removed) that includes a horizontal surface upon which the end 50 is received. Another example includes a beam having a horizontally oriented surface parallel to the floor at a selected landing. Such a beam is supported by the building structure so that the load on the beam is transferred to the associated building structure. The support surface 52 in each case is vertically below the horizontally oriented first portion 32.

Having the end 50 supported in such a way is useful for reducing the amount of the load that must be supported within the hoistway 24. The described examples facilitate transferring at least a portion of the load to the building structure outside of the hoistway.

The example arrangement of the machine support 30 provides for a substantial portion of the load of the machine 35 and the elevator system to be supported by the second portion 34 and transferred to the support surface 52 of the corresponding building. A remaining portion of the load of the machine support 30 and the associated elevator system in this example is supported by the first portion 32 and a structural member at least partially in the hoistway 24. In this example, the first portion 32 has an end opposite from the second portion 34 that is directly supported by the car guide rail 54 such that the portion of the total load that is not directly supported by the second portion 34 and the support surface 52 is supported by the first portion 32 and the car guide rail 54.

In the illustrated example, one end of the first portion 32 is supported by the second portion 34 and an opposite end is supported by the structural member at least partially in the hoistway (i.e., the guide rail 54 in this example). Having the ends of the first portion 32 supported in this manner does not require the outside edges of the first portion 32 to be aligned with the corresponding supporting structure. In other words, the second portion 34 may be positioned somewhere between a center of the first portion 32 and the corresponding end of the first portion 32. Similarly, the structural member that provides support to the first portion 32 near the other end may engage the first portion 32 somewhere between a center of the first portion 32 and the corresponding end of the first portion 32.

In the illustrated examples, the second portion 34 extends outwardly from the front wall defining the hoistway 24 in order for the elevator installation to have as little impact on the construction or refurbishment of the building as possible. If such impact is not a concern, other arrangements are possible. For example, the front wall could have a recess facing the landing or an opening to the hoistway, with the second portion located in the recess or opening.

The example machine support 30 distributes the load supported by the support between the first portion 32 and the second portion 34. In one example, approximately 40% of the total load is borne by the second portion 34 so that it is transferred to and supported by the structure of the building associated with the floor 52. Resting the end 50 of the second portion 34 on the floor 52 (e.g., a concrete slab or a structural steel member that is supported as part of the floor 52 and the associated building) reduces the amount of load that must be supported within the hoistway 24. In such an example, approximately 60% of the load is borne by the first portion 32 and the associated car guide rail 54. The amount of load supported by each portion may vary depending on the elevator duty and the hoistway size.

The illustrated example allows for supporting the vast majority of the loads of the elevator system on one side of the elevator car 22 in a convenient and economical arrangement that minimizes the space required for the elevator system within the hoistway 24 and introduces other economies associated with installing and maintaining the elevator system.

Another guide rail 56 is provided for guiding movement of the car 22 as can be appreciated from FIG. 2. Counterweight guide rails 58 are also provided for facilitating movement of a counterweight 60 that is coupled with the elevator car 22 using a roping arrangement 62. In one example, the roping arrangement 62 comprises a plurality of flat belts. Another example includes round ropes.

In this example, the roping arrangement 62 has one end supported by the terminations 44 that are supported on the first portion 32 of the machine support 30. The roping arrangement 62 follows a path from the terminations 44 around a deflection sheave 64 supported for movement with the counterweight 60 and up to the deflection sheave 42 supported on the first portion 32. The roping arrangement 62 then proceeds around the traction sheave 38, over the deflection sheave 40 and down to deflection sheaves 65 supported for moving with the elevator car 22. The roping arrangement 62 then proceeds upward to terminations 66, which in this example are supported on a bracket 68 secured to the car guide rail 56 on the opposite side of the car 22 from the machine support 30.

The illustrated example includes an under-slung arrangement having deflection sheaves 65 beneath the floor surface of the elevator car 22. Over-slung arrangements are also possible. Additionally, while a 2:1 roping ratio is shown, 1:1 or other roping arrangements can be used.

In the illustrated example, the configuration of the roping arrangement 62 results in horizontal forces on the traction sheave 38 and the machine 35 (i.e., to the right in FIG. 3). Accordingly, in this example, the machine 35 is mounted to a mounting plate 70 on the first portion 32 and secured in place using fasteners 72.

With such an arrangement the entire load of the elevator system is supported by the machine support 30, the structure of the building associated with the support surface 52 and the car guide rails 54 and 56. None of the weight of the elevator system needs to be supported by the counterweight guide rails 58. This allows for using less expensive, lighter weight materials for the counterweight guide rails 58. The movement of the counterweight 60 is the only issue addressed by the counterweight guide rails 58 in this example. Therefore, additional cost savings are possible by using lighter weight materials or different geometry configurations for the guide rails 58 associated with the counterweight 60. Another feature of the illustrated example is that the counterweight 60 can be conveniently positioned between the car guide rail 54 and a front interior wall of the hoistway 24 to provide space savings.

Although the examples in the Figures show that the counterweight rails 58 do not receive any vertical load from the machine support 30, the elevator system 20 could be designed so that the counterweight rails 58 receive some of the vertical load from the machine support 30 if desired.

One feature of this example is that the machine 35 is supported in a location where a mechanic or technician can access the components of the motor or brake of the machine 35 without having to enter the hoistway 24. In this example, the machine 35 is accessible from the landing at the floor 52. Similarly, the control electronics 46 are completely accessible at the landing floor 52. One example includes using a decorative fascia (not shown) to cover over the second portion 34, the housing 48 and the opening at which the machine 35 is accessible so that individuals in the vicinity of the elevator are not aware of the presence of those components. A mechanic or technician has ready, convenient access to all of the operative components associated with working the machine 35 from the landing floor 52. For example, a brake reset lever may be manually manipulated by an individual at the floor level 52 for resetting the elevator brake under required conditions. One feature associated with such an arrangement is that it eliminates the requirement for an electronic or remote brake release. This provides cost savings by reducing the complexity and number of components required for the brake and enhances economies associated with operating and maintaining the elevator system.

Figure 4:
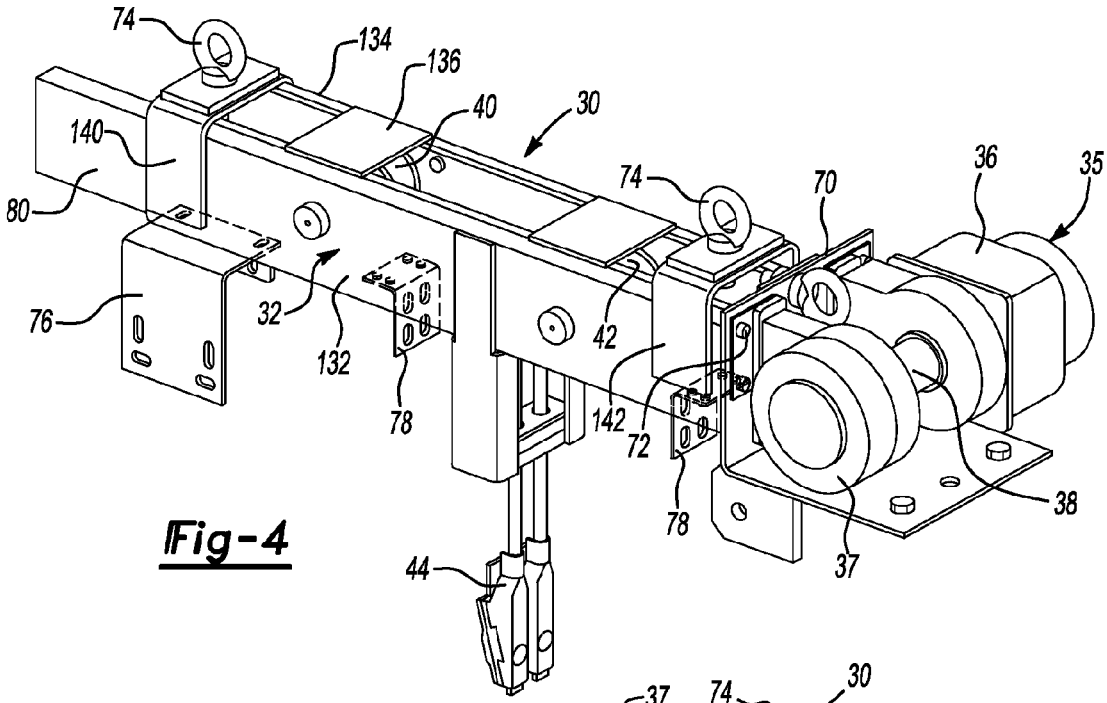
FIG. 4 diagrammatically illustrates selected portions of one example machine support.

In the examples of FIGS. 1-3, the first portion 32 is supported near one end by the second portion 34 and near an opposite end by the car guide rail 54. In the example of FIG. 4, the first portion 32 includes an eye bolt 74 that can be secured to a hanger suspended from a structural member of the associated building. This allows for supporting the first portion 32 by effectively suspending part of it from a structural member of the building located above the machine support 30. With such an arrangement, it is not necessary to support the first portion 32 on a car guide rail 54. Such an arrangement may allow for reducing the cost associated with the car guide rails as they do not need to support as much load as is required in the example of FIGS. 1-3, for example.

The example of FIG. 4 includes a mounting bracket 76 associated with the first portion 32 near one end of the first portion 32. The mounting bracket 76 in this example allows for securing the first portion 32 in a desired position relative to a sidewall of the hoistway 24. The mounting bracket 76 need not be a load supporting mounting bracket but it can operate to transfer some load to the hoistway wall in some examples. An intended feature of the mounting bracket 76 is to secure the machine support 30 in a desired location relative to the hoistway walls to provide accurate positioning of the elevator system components.

The example of FIG. 4 also includes mounting brackets 78 that are useful for securing the upper end of the counterweight guide rails 58 in a desired location within the hoistway 24.

The first portion 32 in this example comprises side beams 132 and 134. A plurality of plates 136, 138 span a space between the side beams 132 and 134. Generally U-shaped brackets 140 and 142 are secured near ends of the side beams 132 and 134. All of these pieces in this example comprise metal and are welded together.

One other feature of the example shown in FIG. 4 is that a governor device 80 is supported by the first portion 32 of the machine support 30. Supporting a governor device 80 on the first portion 32 is also possible in the example of FIGS. 1-3 although a governor device 80 is not specifically illustrated in those drawings nor is it required in such a position in any of the examples. In some examples, the governor device is preinstalled on the first portion 32 prior to the machine support 30 being installed in the hoistway 24.

In the examples of FIGS. 1-3 and 4, the axis of rotation of the traction sheave 38 is oriented parallel to the front wall of the hoistway 24 (i.e., the wall defining a front of the hoistway). The motor 36 including the shaft of the motor and the brake 37 extend along the same wall. At least a portion of the machine 35 is within a boundary of that wall as can be appreciated in FIGS. 3 and 7.

Figure 5:
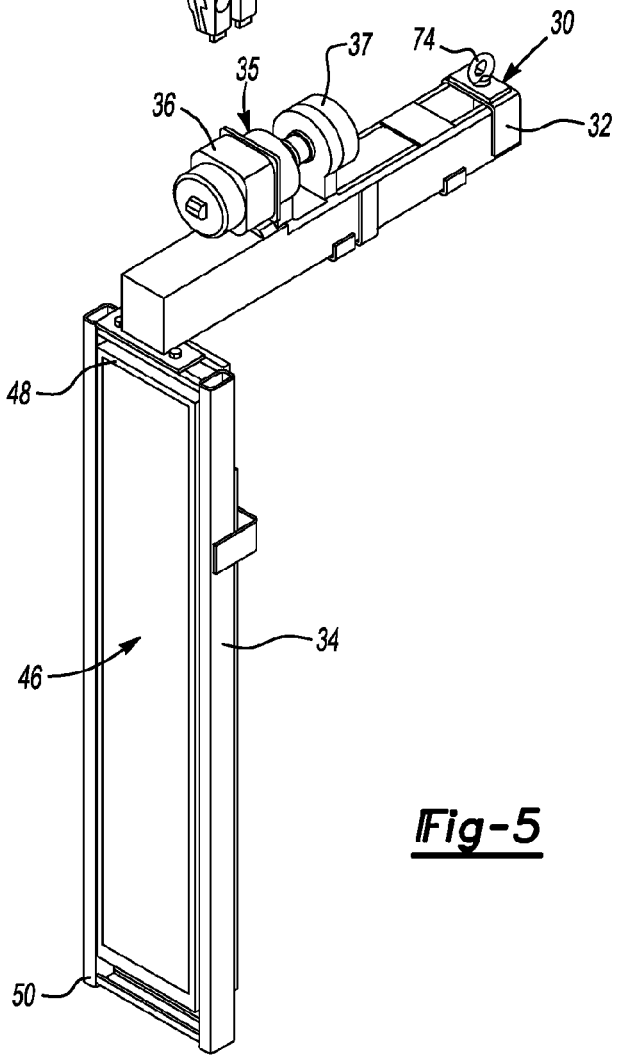
FIG. 5 schematically illustrates selected portions of another example arrangement of an elevator system.

The example of FIG. 5 includes the machine 35 supported on the first portion 32 such that the axis of rotation of the traction sheave 38 is parallel to a side wall of a hoistway. The motor 36 including the shaft of the motor and the brake 37 extend along the same wall. At least a portion of the machine 35 is within a boundary of that wall as can be appreciated in FIGS. 3 and 7. With the embodiment of FIG. 5 the path followed by the roping arrangement 62 will be modified compared to that in the example of FIGS. 1-3. Given this description, those skilled in the art will be able to provide a suitable roping arrangement configuration to meet their needs for a particular elevator system.

In the examples of FIGS. 1-5, the first portion 32 of the machine support 30 is located on one side of the hoistway 24 as can be appreciated from FIG. 1, for example. In other words, the first portion 32 of the machine support 30 in the examples of FIGS. 1-5 resides in the top part of the hoistway 24 in the space between the sidewall 25 defining the hoistway 24 and the space needed by the elevator car 24 on its path along the rails 54, 56. The first portion 32 may be in the overhead extension of the space needed by the car 22.

Figure 6:
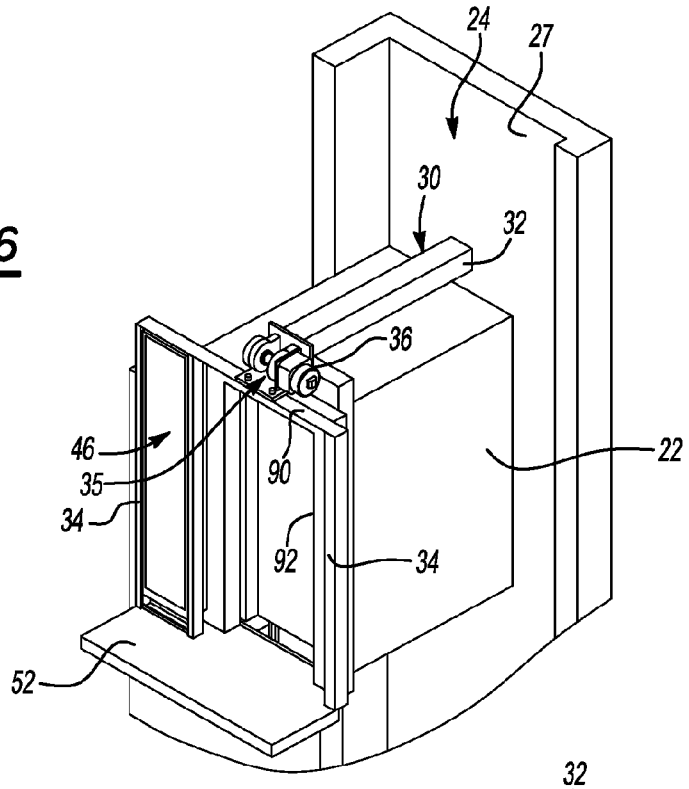
FIG. 6 schematically illustrates another example arrangement of an elevator system.

FIG. 6 schematically illustrates another arrangement where the first portion 32 is centered above an opening 92 for the car doors of the elevator car 22 and resides in the overhead extension of the space needed by the elevator car 24 on its path along the rails 54, 56. In this example, the second portion 34 includes some support elements on one side of the elevator door opening 92 at the landing of the floor 52 and other support elements on an opposite side of the door opening. In the example of FIG. 6, a crossbeam 90 is positioned above the elevator car door opening 92. One end of the first portion 32 near the machine 35 is supported on the crossbeam 90. In this example, an opposite end of the first portion 32 is supported by the building structure along the rear wall defining the hoistway 24. In another example, the first portion 32 is suspended from an overhead structural member above the machine support 30 so that the loads carried by the machine support 30 are transferred to the building structure including having a substantial portion of the load (e.g., 40%) transferred to the support surface 52 and the associated building structure (e.g., a floor surface or at least one structural member vertically below the first portion 32).

Figure 7:
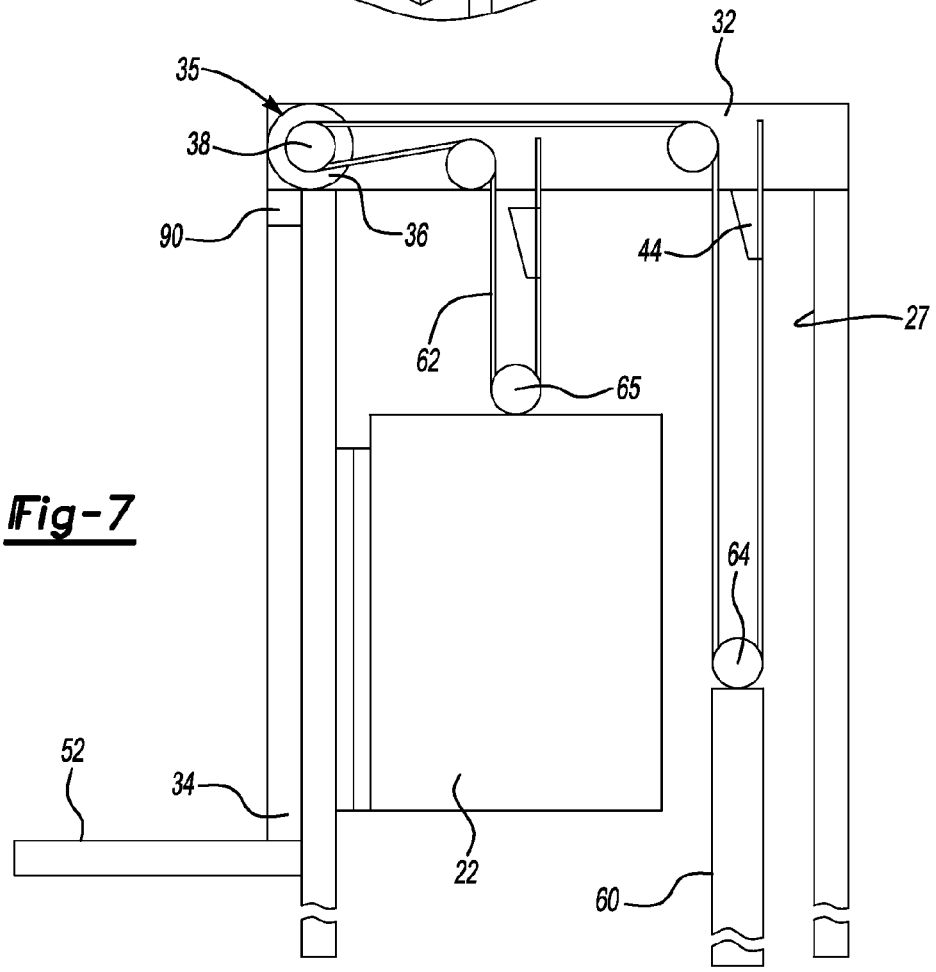
FIG. 7 schematically illustrates selected features of the example of FIG. 6.

FIG. 7 schematically shows a side view of the example of FIG. 6. In this example, the counterweight 60 is located behind the elevator car 22 rather than being on the side of it as in the example of FIGS. 1-3. The elevator car 22 includes the deflection sheave 65 on top of the car 22 rather than having an under-slung arrangement as in the example of FIGS. 1-3. Although this example shows an over-slung arrangement in the Figures, other arrangements are also possible with this example. For instance, the roping arrangement 62 could terminate on the top of the car 22.

Another feature of the example of FIGS. 6 and 7 is that the machine support 30 does not need to be supported on any of the guide rails for the elevator car 22 or the counterweight 60. Instead, the first portion 32 of the machine support 30 is supported by the rear wall 27 defining the hoistway 24 using a suitable mounting arrangement or a notch in that wall. Although described with this example, all of the other described examples could mount the first portion 32 to the rear wall 27 (or the sidewall 25) defining the hoistway 24. In each instance, the corresponding wall is considered at least partially within the hoistway 24. Accordingly, all of the guide rails 54, 56 and 58 may be made from a lightweight material and do not have the same structural constraints on them compared to elevator systems where the guide rails support the vertical load. In the example of FIG. 7, the terminations for the roping arrangement 62 are all supported by the first portion 32 of the machine support 30. Being able to use lighter weight materials for the guide rails provides cost savings, for example.

Additionally, where the guide rails in the elevator system do not need to support vertical loads, it is possible to secure the rails in position at fewer locations along the height of the hoistway 24. This provides a material savings in that fewer mounting brackets are required for the guide rails. Additionally, less installation time is required for installing the rails.

The first portion 32 and second portion 34 of the machine support 30 could be attached together using any suitable method. For example, the first portion 32 and second portion 34 could be permanently affixed together. In these examples, the first portion 32 and the second portion 34 could be welded together (either prior to or after installation in the hoistway 24). In other examples, the first portion 32 and second portion 34 could be removably mounted together. In these examples, an individual could manually secure the two portions relative to each other in a desired orientation (e.g., perpendicular) using, for example, fasteners at any desired point such as while the machine support 30 is still located near the lowermost landing of the hoistway 24 or after positioning the first portion 32 and second portion 34 in their final installation positions relative to the hoistway.

Figure 8:
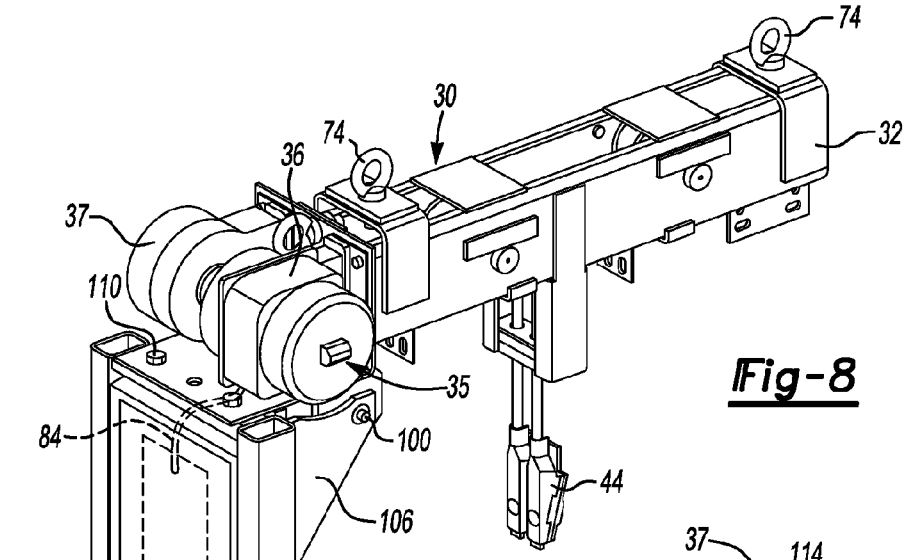
FIG. 8 diagrammatically illustrates an example machine support having components of the support in a first orientation.

FIG. 8 diagrammatically illustrates an example arrangement where the first portion 32 and the second portion 34 are pivotally secured together so that one portion can pivot relative to the other. In the example of FIG. 8, relative pivotal motion between the first portion 32 and the second portion 34 occurs about a pivot axis 100. The first portion 32 and second portion 34 are selectively moveable relative to each other from a first orientation in which the two portions are generally parallel to each other as shown in FIG. 9 into a second orientation in which the two portions are generally perpendicular to each other as shown in FIG. 8, for example.

Figure 9:
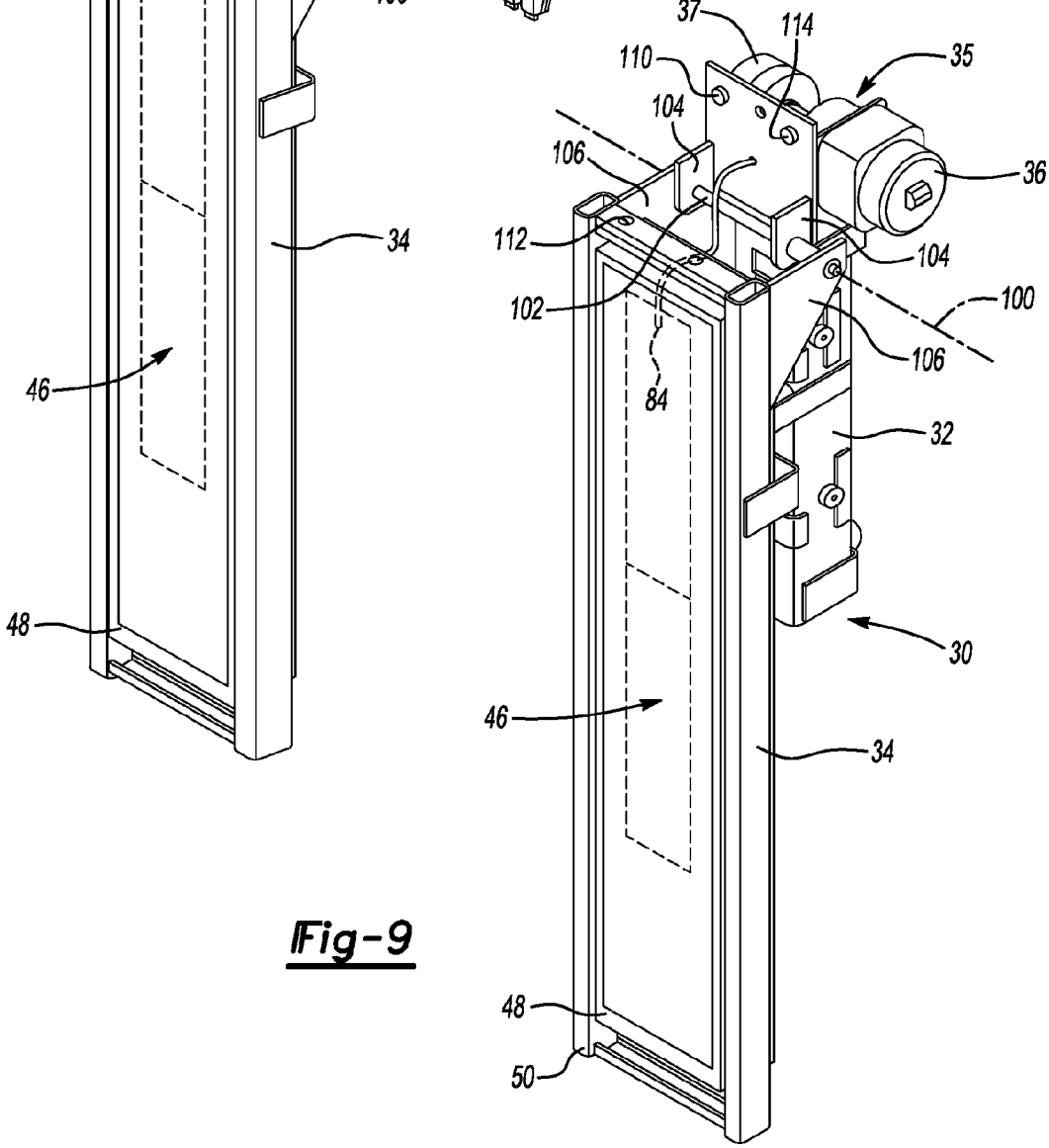
FIG. 9 diagrammatically illustrates the example of FIG. 8 having the machine support components in a second orientation.

As best appreciated from FIG. 9, a rod 102 extends through openings in flanges 104 associated with the first portion 32 and flanges 106 associated with the second portion 34. In this example, the centerline of the rod 102 is coincident with the pivot axis 100 about which the two portions can move relative to each other.

One feature of this example is that the machine support 30 with all of the pre-mounted components such as the control electronics 46, the machine 36, the terminations 44 and a governor 80 with all of the components preconnected and prewired can be delivered to an installation site in the configuration shown in FIG. 9. During an installation procedure, the first portion 32 and second portion 34 are manipulated relative to each other such that they pivot about the pivot axis 100 and eventually are moved into the orientation shown in FIG. 8. This example includes fasteners 110 that are received through openings 112 in the second portion 34 and corresponding openings 114 in the first portion 32. The fasteners may comprise nuts and bolts in one example. The fasteners 110 secure the two portions relative to each other in a desired orientation upon proper installation in an elevator system.

The disclosed examples provide added features such as having the machine 35 and any components of the elevator system in the housing 48 all accessible from an upper floor 52 of the building without requiring an individual to enter the hoistway to perform many maintenance procedures.

The preceding description is illustrative and not limiting. A worker of ordinary skill in the art would recognize that certain modifications to the disclosed examples are possible and that features described in one example are not necessarily limited to that example and could be used in another example. For that reason, the following claims should be studied to determine the scope of legal protection provided to this invention.

We claim:

1. An elevator system, comprising:
a hoistway;
a machine support including
a first portion situated in a generally horizontal position at least partially within the hoistway and
a second portion oriented generally perpendicular to the first portion, the second portion being located at least partially outside the hoistway and having one end supported by a horizontally oriented support surface outside the hoistway such that a portion of a load of the machine support is transferred to the support surface,
one end of the first portion being supported by the second portion and another end of the first portion being supported by a structural member at least partially in the hoistway such that a remainder of the load of the machine support is transferred to the structural member.

2. The elevator system of claim 1, wherein the structural member comprises a guide rail and the first portion is supported on the guide rail such that the remainder of the load of the machine support is transferred down the guide rail.

3. The elevator system of claim 1, wherein the structural member comprises a hanger positioned above the first portion such that the remainder of the load of the machine support is suspended from the hanger.

4. The elevator system of claim 1, comprising
a machine connected to at least the first portion;
at least one deflector sheave supported on the first portion;
a plurality of terminations supported on the first portion; and
a controller supported on the second portion.

5. The elevator system of claim 4, comprising
a governor device supported on the machine support.

6. The elevator system of claim 1, comprising
a counterweight;
a plurality of counterweight guide rails; and
a plurality of counterweight rail mounting brackets supported on the first portion for positioning one end of the counterweight guide rails in the hoistway.

7. The elevator system of claim 1, wherein the first portion is removably connected to the second portion.

8. The elevator system of claim 1, wherein the first and second portions are pivotally connected together and the machine support has a first configuration in which the first portion is generally parallel with the second portion and a second configuration in which the first portion is generally perpendicular to the second portion.

9. The elevator system of claim 1, wherein the first portion is permanently connected to the second portion.

10. The elevator system of claim 1, comprising motor and brake supported on the machine support and positioned to be at least partially accessible from outside the hoistway.

11. The elevator system of claim 1, wherein the support surface comprises a floor at a landing adjacent the hoistway.

12. The elevator system of claim 1, wherein the first and second portions are located on one side of a door opening adjacent the hoistway.

13. The elevator system of claim 12, comprising
an elevator car;
first and second elevator car guiderails for guiding movement of the elevator car in the hoistway;
a counterweight on a side of the elevator car corresponding to the side on which the first and second portions are located such that the counterweight is beneath and vertically aligned with the first portion;

a first set of terminations supported on the first portion;

a second set of terminations supported on one of the elevator car guiderails; and a roping arrangement that suspends the elevator car and counterweight, the roping arrangement having one end at the first set of terminations, the roping arrangement wrapping at least partially about a deflection sheave supported for movement with the counterweight then wrapping at least partially about a deflection sheave supported on the first portion then wrapping at least partially around a traction sheave supported on the machine support then wrapping at least partially around another deflection sheave supported on the first portion the wrapping at least partially about a deflection sheave supported for movement with the elevator car and having another end at the second set of terminations.

14. The elevator system of claim 1, wherein the first portion is centrally located within the hoistway above a door opening at the floor and the second portion comprises one member on one side of the door opening, another member on another side of the door opening and a cross member between the members and wherein the first portion is supported on the cross member.

15. The elevator system of claim 13, wherein the counterweight is located on a side of the hoistway opposite from the door opening.

16. An elevator system, comprising:

a hoistway;

a machine support including a first portion situated in a generally horizontal position at least partially within the hoistway and a second portion oriented generally perpendicular to the first portion, the second portion having one end supported by a horizontally oriented support surface outside the hoistway such that a portion of a load of the machine support is transferred to the support surface, one end of the first portion being supported by the second portion and another end of the first portion being supported by a structural member at least partially in the hoistway such that a remainder of the load of the machine support is transferred to the structural member; and a housing that contains at least some of elevator system electronics, the housing having a rigidity that establishes some of the second portion such that the housing structure supports a portion of the load of the machine support between the first portion and the support surface.

17. A machine support in an elevator system, comprising a first portion configured to be disposed at least partially within a hoistway; and a second portion pivotally connected with the first portion to allow for selective relative movement between the first and second portions between a first configuration in which the first and second portions are generally parallel to each other and a second configuration in which the first and second portions are generally perpendicular to each other, the second portion being at least partially outside of the hoistway in the second configuration, the second portion being supported by a horizontally oriented support surface outside the hoistway.

18. The machine support of claim 17, in combination with a machine including a motor, brake and traction sheave connected to at least the first portion.

19. The machine support of claim 18, in combination with at least one deflection sheave supported on the first portion; and a plurality of terminations supported on the first portion for securing an end of a load bearing member in a selected position relative to the first portion.

20. The machine support of claim 18, comprising a governor device supported on the first portion.

* * * * *